US007141142B2

(12) United States Patent
Burazin et al.

(10) Patent No.: US 7,141,142 B2
(45) Date of Patent: Nov. 28, 2006

(54) METHOD OF MAKING PAPER USING REFORMABLE FABRICS

(75) Inventors: Mark Alan Burazin, Oshkosh, WI (US); Andrew Peter Bakken, Appleton, WI (US); Irene Beatrice Strohbeen, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 284 days.

(21) Appl. No.: 10/672,831

(22) Filed: Sep. 26, 2003

(65) Prior Publication Data

US 2005/0067125 A1 Mar. 31, 2005

(51) Int. Cl.

| | |
|---|---|
| ***D21F 1/10*** | (2006.01) |
| ***D21F 7/08*** | (2006.01) |
| ***D21F 7/12*** | (2006.01) |
| ***D21F 5/18*** | (2006.01) |

(52) U.S. Cl. ..... 162/199; 162/109; 162/116; 162/207; 162/348; 162/358.2; 162/361; 162/900; 162/902; 163/903; 442/168; 35/116; 35/123

(58) Field of Classification Search ..... 162/109–117, 162/205–207, 348, 358.1, 358.2, 900, 902, 162/903, 361; 34/111, 116, 123; 442/221–225, 442/268–294; 428/141, 152–154, 156–187
See application file for complete search history.

(56) References Cited

U.S. PATENT DOCUMENTS

| | | | | |
|---|---|---|---|---|
| 3,034,180 | A * | 5/1962 | Greiner et al. | 19/301 |
| 3,338,992 | A | 8/1967 | Kinney | |
| 3,341,394 | A | 9/1967 | Kinney | |
| 3,423,266 | A | 1/1969 | Davies et al. | |
| 3,485,706 | A | 12/1969 | Evans | |
| 3,494,821 | A | 2/1970 | Evans | |
| 3,502,538 | A | 3/1970 | Petersen | |
| 3,502,763 | A | 3/1970 | Hartmann | |
| 3,542,615 | A | 11/1970 | Dobo et al. | |
| 3,556,932 | A | 1/1971 | Coscia et al. | |
| 3,556,933 | A | 1/1971 | Williams et al. | |
| 3,585,104 | A | 6/1971 | Kleinert | |
| 3,595,245 | A | 7/1971 | Buntin et al. | |
| 3,595,731 | A | 7/1971 | Davies et al. | |
| 3,597,299 | A | 8/1971 | Thomas et al. | |
| 3,652,389 | A * | 3/1972 | Helland | 162/275 |
| 3,676,242 | A | 7/1972 | Prentice | |
| 3,692,618 | A | 9/1972 | Dorschner et al. | |

(Continued)

FOREIGN PATENT DOCUMENTS

| | | |
|---|---|---|
| CA | 803714 | 1/1969 |

(Continued)

OTHER PUBLICATIONS

Bieman, Dr. Leonard H., Kevin G. Harding, and Albert Boehnlein, "Absolute Measurement Using Field Shifted Moiré," Proceedings of Optics, Illumination, and Image Sensing for Machine Vision VI, SPIE vol. 1614, Nov. 1991, pp. 259-264.

(Continued)

*Primary Examiner*—Eric Hug
(74) *Attorney, Agent, or Firm*—Gregory E. Croft

(57) ABSTRACT

Papermaking fabrics, particularly those fabrics useful for making tissue and towel products, can be modified to alter their structure, such as surface texture, and re-used to make a different product. The fabrics can be modified after removal from the paper machine or while on the paper machine, including while the machine is running, so that down time between making different products can be eliminated or greatly reduced.

33 Claims, 14 Drawing Sheets

U.S. PATENT DOCUMENTS 3,704,198 A 11/1972 Prentice
3,715,251 A 2/1973 Prentice
3,729,785 A 5/1973 Sommer
3,879,257 A 4/1975 Gentile et al.
3,881,987 A * 5/1975 Benz ..... 162/116
3,890,681 A 6/1975 Fekete et al.
3,993,532 A 11/1976 McDonald et al.
4,041,203 A 8/1977 Brock et al.
4,068,036 A 1/1978 Stanistreet
4,314,001 A 2/1982 Wesseler
RE30,955 E 6/1982 Stanistreet
4,340,563 A 7/1982 Appel et al.
4,363,684 A 12/1982 Hay, II
4,374,888 A 2/1983 Bornslaeger
4,440,597 A 4/1984 Wells et al.
4,514,345 A 4/1985 Johnson et al.
4,522,863 A 6/1985 Keck et al.
4,528,239 A 7/1985 Trokhan
4,529,480 A 7/1985 Trokhan
4,551,199 A 11/1985 Weldon
4,659,614 A 4/1987 Vitale
4,731,276 A 3/1988 Manning et al.
4,737,393 A 4/1988 Linkous
4,740,409 A 4/1988 Lefkowitz
4,766,029 A 8/1988 Brock et al.
4,808,467 A 2/1989 Suskind et al.
4,842,905 A * 6/1989 Stech ..... 428/33
4,849,054 A 7/1989 Klowak
4,886,632 A 12/1989 Van Iten et al.
4,919,877 A 4/1990 Parsons et al.
4,926,533 A 5/1990 Couture
4,962,576 A 10/1990 Minichshofer et al.
5,038,775 A 8/1991 Maruscak et al.
5,069,548 A 12/1991 Boehnlein
5,096,532 A 3/1992 Neuwirth et al.
5,098,522 A 3/1992 Smurkoski et al.
5,139,841 A 8/1992 Makoui et al.
5,167,771 A 12/1992 Sayers et al.
5,169,706 A 12/1992 Collier, IV et al.
5,178,729 A 1/1993 Janda
5,227,242 A 7/1993 Walter et al.
5,260,171 A 11/1993 Smurkoski et al.
5,268,076 A 12/1993 Best et al.
5,275,700 A 1/1994 Trokhan
5,328,565 A 7/1994 Rasch et al.
5,334,289 A 8/1994 Trokhan et al.
5,336,552 A 8/1994 Strack et al.
5,353,521 A 10/1994 Orloff
5,360,656 A 11/1994 Rexfelt et al.
5,431,786 A 7/1995 Rasch et al.
5,464,688 A 11/1995 Timmons et al.
5,496,624 A 3/1996 Stelljes, Jr. et al.
5,500,277 A 3/1996 Trokhan et al.
5,503,715 A 4/1996 Trokhan et al.
5,511,294 A 4/1996 Fehrer
5,512,319 A 4/1996 Cook et al.
5,514,523 A 5/1996 Trokhan et al.
5,554,467 A 9/1996 Trokhan et al.
5,566,724 A 10/1996 Trokhan et al.
5,573,637 A 11/1996 Ampulski et al.
5,598,642 A 2/1997 Orloff et al.
5,598,643 A 2/1997 Chuang et al.
5,607,980 A 3/1997 McAtee et al.
5,614,293 A 3/1997 Krzysik et al.
5,624,790 A 4/1997 Trokhan et al.
5,628,876 A 5/1997 Ayers et al.
5,643,588 A 7/1997 Roe et al.
5,643,653 A 7/1997 Griesbach, III et al.
5,650,218 A 7/1997 Krzysik et al.
5,656,132 A 8/1997 Farrington, Jr. et al.
5,667,636 A 9/1997 Engel et al.
5,699,626 A 12/1997 Chuang et al.
5,701,682 A 12/1997 Chuang et al.
5,713,399 A 2/1998 Collette et al.
5,716,692 A 2/1998 Warner et al.
5,817,377 A 10/1998 Trokhan et al.
5,827,384 A 10/1998 Canfield et al.
5,830,321 A 11/1998 Lindsay et al.
5,855,739 A 1/1999 Ampulski et al.
5,871,613 A 2/1999 Bost et al.
5,871,763 A 2/1999 Luu et al.
5,882,573 A 3/1999 Kwok et al.
5,885,416 A 3/1999 Marinack et al.
5,885,418 A 3/1999 Anderson et al.
5,893,965 A 4/1999 Trokhan et al.
5,897,745 A 4/1999 Ampulski et al.
5,904,298 A 5/1999 Kwok et al.
5,932,291 A 8/1999 Sayers et al.
5,935,381 A 8/1999 Trokhan et al.
5,972,813 A 10/1999 Polat et al.
5,986,167 A 11/1999 Arteman et al.
5,990,377 A 11/1999 Chen et al.
6,001,300 A 12/1999 Buckley
6,010,598 A 1/2000 Boutilier et al.
6,017,417 A 1/2000 Wendt et al.
6,071,837 A 6/2000 Crook
6,080,691 A 6/2000 Lindsay et al.
6,096,169 A 8/2000 Hermans et al.
6,103,060 A 8/2000 Munerelle et al.
6,120,642 A * 9/2000 Lindsay et al. ..... 162/109
6,124,015 A 9/2000 Baker et al.
6,143,135 A 11/2000 Hada et al.
6,149,768 A 11/2000 Hepford
6,162,518 A 12/2000 Korfer
6,171,442 B1 1/2001 Farrington, Jr. et al.
6,197,154 B1 3/2001 Chen et al.
6,200,669 B1 3/2001 Marmon et al.
6,240,608 B1 6/2001 Paquin et al.
6,398,910 B1 6/2002 Burazin et al.
6,420,100 B1 7/2002 Trokhan et al.
6,461,474 B1 10/2002 Lindsay et al.
6,565,713 B1 5/2003 Hansen et al.
6,569,290 B1 * 5/2003 Johnson ..... 162/348
6,592,714 B1 7/2003 Lamb
6,699,366 B1 3/2004 Paquin et al.
6,702,927 B1 3/2004 Moriarty et al.
6,723,208 B1 4/2004 Hansen
6,726,809 B1 * 4/2004 Joyce et al. ..... 162/358.1
2002/0055310 A1 * 5/2002 Falk et al. ..... 442/20
2002/0104631 A1 8/2002 Hansen et al.
2003/0102098 A1 * 6/2003 Allen et al. ..... 162/203

FOREIGN PATENT DOCUMENTS

EP 0 394 134 * 10/1990
EP 0 653 512 B1 2/1998
EP 0 999 306 A2 5/2000
EP 1 045 066 A2 10/2000
EP 1 063 349 A2 12/2000
EP 1 157 817 A2 11/2001
GB 1008703 * 11/1965
GB 1217892 A 12/1970
GB 2 202 873 A 10/1988
GB 2 254 287 A 10/1992
JP 2003-227086 A 8/2003
JP 2003-239190 A 8/2003
JP 2003-239191 A 8/2003
JP 2003-239192 A 8/2003
WO WO 95/18157 A1 7/1995
WO WO 95/21285 A1 8/1995
WO WO 98/01618 A1 1/1998
WO WO 98/27277 * 6/1998
WO WO 98/53138 A1 11/1998
WO WO 99/09247 A1 2/1999

| | | | |
|---|---|---|---|
| WO | WO 01/26595 | A1 | 4/2001 |
| WO | WO 02/29157 | A1 | 4/2002 |
| WO | WO 02/41815 | A2 | 5/2002 |

OTHER PUBLICATIONS

Courtney, Patrick J. and Christine M. Salerni, "Shedding New Light on Adhesives," Adhesives Age, vol. 44, No. 2, Feb. 2001, pp. 38,40-41, 49.

Lindsay, Jeffrey D., "Displacement Dewatering To Maintain Bulk," Paperi Ja Puu—Paper And Timber, vol. 74, No. 3, 1992, pp. 232-242.

Malkan, Sanjiv R. and Larry C. Wadsworth, "Process-Structure-Property Relationships In Melt Blowing Of Different Molecular Weight Polypropylene Resins, Part 1—Physical Properties," INDA Journal of Nonwovens Research, vol. 3, No. 2, Spring 1991, pp. 21-34.

Mummery, Leigh, Surface Texture Analysis: The Handbook, published by Hommelwerke GmbH, Muhlhausen, Germany, 1990, pp. 28-29 and 34-47.

Wente, V.A. et al., "Manufacture of Superfine Organic Fibers," NRL Report 4364, U.S. Naval Research Laboratory, Washington, D.C., May 25, 1954, pp. 1-15.

Wente, Van A., "Superfine Thermoplastic Fibers," Industrial and Engineering Chemistry, vol. 48, No. 8, Aug. 1956, pp. 1342-1346.

* cited by examiner

METHOD OF MAKING PAPER USING REFORMABLE FABRICS

In the manufacture of tissue products such as facial tissue, bath tissue, paper towels and the like, it is often necessary to change certain fabrics on the papermaking machine when changing over to different products or grades. For example, when switching between making throughdried bath tissues and towels, the throughdrying fabric typically needs to be changed each time a different product is to be made because the desired three-dimensional topography of each product is typically different. In order to change the fabric, the paper machine must be shut down, which results in several hours of machine down time and loss of productivity. Also, repeated shutdowns and start-ups of the machine and the attendant drop and rise in processing temperatures cause thermal cyclic fatigue to the throughdryers, which ultimately necessitates a costly replacement. In addition, papermaking fabrics become brittle with age and the risk of damage to the fabric increases during fabric changes. Furthermore, papermaking fabrics are expensive, so that replacing them adds to the manufacturing cost and keeping a large inventory of fabrics also increases costs.

Therefore, there is a need to be able to reduce the fabric inventory and machine down time when switching production between different products or between different grades of the same product.

SUMMARY OF THE INVENTION

It has now been discovered that paper machine productivity can be improved by altering the structure, such as the surface contour and/or drainage characteristics, of papermaking fabrics for re-use, preferably while on the machine.

Hence in one aspect, the invention resides in a method of making paper in which a web of papermaking fibers is supported by the web-contacting surface of a fabric, wherein the structure of fabric is purposefully modified, either while the fabric is on-line or off-line, such that the structure of the resulting paper is changed. The change in structure imparted to the product can be a change in texture, for example, which can alter the bulk or perceived softness of the resulting paper product. Alternatively, or in addition, the change in structure imparted to the product can be more subtle, such as changing a watermark. More particularly, if the fabric being purposefully modified is a throughdrying fabric for making tissues or towels and the like, for example, the modification of the throughdrying fabric structure can be focused on the surface of the throughdrying fabric in order to alter the texture of the fabric and, in turn, alter the texture of the resulting paper product. Alternatively, if the fabric being purposefully modified is a forming fabric, for example, the modification to the fabric structure can be focused more on other structural features of the fabric, rather than the surface texture, in order to modify the drainage or fluid flow characteristics of the fabric. Such a modification can be used to change watermarks on the product, for example.

In another aspect, the invention resides in a method of making a throughdried tissue on a papermaking machine in which a throughdrying fabric contacts and supports a tissue web while the web is being dried, wherein the texture of the web-contacting surface of the throughdrying fabric, while not in contact with the web, is purposefully modified.

In another aspect, the invention resides in a method of making tissue comprising: (a) making a first throughdried tissue on a papermaking machine in which a throughdrying fabric contacts and supports a tissue web while the web is being dried, wherein the texture of the web-contacting surface of the throughdrying fabric imparts a first texture to the first tissue; (b) reforming the web-contacting surface of the throughdrying fabric from a first texture to a second texture; and (c) making a second throughdried tissue wherein the second texture of the web-contacting surface of the throughdrying fabric imparts a second texture to the second tissue.

In another aspect, the invention resides in a method of making paper on a papermaking machine in which a web of papermaking fibers is supported by the web-contacting surface of a forming fabric which imparts a watermark to the web, wherein the web-contacting surface of the forming fabric is purposefully modified, either while the fabric is on-line or off-line, such that the watermark imparted by the forming fabric is changed.

In another aspect, the invention resides in a method of making paper on a papermaking machine in which a web of papermaking fibers is supported by the web-contacting surface of a forming fabric, wherein the forming fabric is supported by an open form roll sleeve which imparts a watermark to the web, wherein the open form roll sleeve is purposefully modified, either while the form roll sleeve is on-line or off-line, such that the watermark imparted by the open form roll sleeve is changed.

In another aspect, the invention resides in a used papermaking fabric wherein the structure of the fabric has been purposefully modified for re-use. The term "used" means that the fabric has been previously used to make paper.

As used herein, the term "purposefully modified" means an intentional structural modification to a fabric that is more than mere structural change associated with ordinary fabric wear during normal use. The term is intended to encompass alterations to the fabric made only for the purpose of changing the overall visual or functional properties of the resulting paper product or extending the useful life of the fabric, such as by rebuilding or rejuvenating a worn down topography.

Specific papermaking fabrics suitable for modification include forming fabrics, form roll sleeves, dandy roll covers, transfer fabrics, imprinting fabrics, press fabrics, impression fabrics, carrier belts and throughdrying fabrics. Throughdrying fabrics are particularly suitable for this invention because throughdrying fabrics are commonly used to impart texture or distinguishing properties to the final paper product.

The means for modifying the structure of the fabric can depend upon the nature of the supporting fabric. For example, purely woven fabrics lend themselves to having a texture-modifying material added to the web-contacting surface of the woven fabric. Addition of the material can be done on-line (while the fabric is moving on the paper machine) or off-line (while the fabric is removed from the paper machine or while the fabric is on the machine, but the machine is not running or otherwise not producing product). A protective coating can, optionally, first be added to the woven fabric in order to make the subsequently added texture-modifying material readily removable, when desired, without damaging the underlying woven fabric base. Also, woven fabrics can be abraded to change the web-contacting surface texture, particularly going from high texture to lower texture one or more times. On the other hand, non-woven fabrics and woven fabrics having a non-woven web-contacting surface layer particularly lend themselves to being thermomechanically modified, such as by being passed through a hot embossing nip to reconfigure the non-woven fibers or fiber layer, or by through-air-molding by passing hot air through the non-woven fabric to re-mold it into a different surface configuration. Through-air-molding is suitable for substantially non-compressive reformation of the web-contacting surface and suitable for producing a reformed fabric having substantially uniform density. Ideally, this thermal modification can be repeated two or more times as needed for multiple product changes.

Woven fabrics suitable for use in accordance with this invention are well known in the papermaking arts. Examples include, without limitation, those described in U.S. Pat. No. 6,171,442 entitled "Soft Tissue" issued Jan. 9, 2001 to Farrington et al. and U.S. Pat. No. 6,017,417 entitled "Method of Making Soft Tissue Products" issued Jan. 25, 2000 to Wendt et al., both of which are herein incorporated by reference.

Non-woven fabrics or non-woven materials suitable for use in accordance with this invention include any non-woven structure having the mechanical strength and stability necessary for use a papermaking machine. Meltblowing and spunbonding are well known methods of producing suitable non-woven webs. Generally described, the process for making spunbond non-woven webs includes extruding thermoplastic material through a spinneret and drawing the extruded material into filaments with a stream of high-velocity air to form a random web on a collecting surface. Such a method is referred to as melt spinning. On the other hand, meltblown non-woven webs are made by extruding a thermoplastic material through one or more dies, blowing a high-velocity stream of air past the extrusion dies to generate an air-conveyed melt-blown fiber curtain and depositing the curtain of fibers onto a collecting surface to form a random non-woven web.

The presence of multi-component materials, such as bi-component fibers and filaments, in non-woven materials used herein can be helpful in molding and altering the surface structure. A bi-component non-woven web can be made from polymeric fibers or filaments including first and second polymeric components which remain distinct. The first and second components can be arranged in substantially distinct zones across the cross-section of the filaments and extend continuously along the length of the filaments. Suitable embodiments include concentric or asymmetrical sheath-core structures or side-by-side structures. Typically, one component exhibits different properties than the other so that the filaments exhibit properties of the two components. For example, one component may be polypropylene, which is relatively strong, and the other component maybe polyethylene, which is relatively soft. The end result is a strong, yet soft, non-woven web. Accordingly, bi-component structures can be selected depending on the needs of the non-woven material or, if layered, the layers of the non-woven material of the non-woven tissue making fabric under consideration. Sheath-core filaments with a thermoplastic sheath can be particularly useful because heating and cooling of the non-woven material fuses the thermoplastic material of the sheath of one filament to another in order to better lock the molded structure in place. Likewise, a first portion of fibers in the non-woven material can be thermoplastic with a lower melting point than a second portion of fibers in the non-woven material, such that the first portion of fibers can more easily melt and fuse the second portion of fibers together in the molded shape.

Methods for making bi-component non-woven webs are well known in the art and are disclosed in patents such as: Reissue No. 30,955 of U.S. Pat. No. 4,068,036, issued on Jan. 10, 1978 to Stanistreet; U.S. Pat. No. 3,423,266, issued on Jan. 21, 1969 to Davies et al.; and U.S. Pat. No. 3,595,731, issued on Jul. 27, 1971 to Davies et al., all of which are herein incorporated by reference.

A variety of materials and means to add and remove materials are available as desired. These are especially useful in connection with woven fabrics. Particularly suitable means for applying materials include printing and extrusion. Options include, without limitation:

(1) Using a material that is pH sensitive. Under standard running conditions the added material would be a solid, thus producing a paper product reflecting the web-contacting surface texture imparted by the pattern of the deposit. When a product or grade change is necessary, the pH of the fabric wash system would be changed to dissolve the material. After a buffer flush to bring the pH back to standard conditions, a new deposit design can be applied to the washed fabric and a new paper product can be made. This procedure could be repeated as many times as desired before the base fabric wears out (typically about 45 days). Materials that are pH-triggerable are known, such as A426 carboxylated vinyl acetate-ethylene terpolymer manufactured by Air Products Polymers, LP, Allentown, Pa., where a dried film of this material dissolves at or above a pH of 9.5.

(2) Using a material that binds to the base fabric, but decomposes when reacted with another chemical. Exposing this material to the trigger chemical would "erase" the deposit pattern. After washing the fabric, a new material deposit pattern could be applied. An example of a deposit material is a vinyl polymer, such as polyisobutylene or poly($\alpha$)-methylstyrene, and a corresponding trigger chemical is ozone.

(3) Using a material that dissolves in a non-aqueous solvent. When it is desired to change the pattern, the material could be extracted from the fabric with the solvent. Using solvents to selectively extract polymeric materials is fairly common in the chemical process industry.

(4) Using a material that decomposes when exposed to ultra-violet (UV) light. UV light is a common catalyst for decomposition reactions for organic polymers.

(5) Using a material that detaches from the base fabric or decomposes when exposed to ultrasonic vibrations. This would be very similar to a high energy washing process.

(6) Using a material that can be readily abraded from the web-contacting surface of the fabric. A differentially turning roll or a stationary object in contact with the moving web-contacting surface of the fabric could remove the deposits. More elegantly, dry ice could be used to "sand blast" the web-contacting surface to remove the pattern without leaving any material residue.

(7) Using a material that has a different rate of thermal expansion than the base fabric material. Such a material can be "thermally shocked" to pop it off of the fabric. For example, exposing the material to a rapid decrease in temperature (using liquid nitrogen, for example), the stresses at the deposit/fabric interface would increase dramatically and the interface would crack, thus releasing the material deposits from the fabric.

(8) Using adhesive to adhere a pre-formed pattern of material on to the web-contacting surface of the fabric. The adhesive could be altered by any of the foregoing means to release the material from the fabric.

(9) Using a material with a relatively low melting point (for example, between 130 and 190° C.) between the sheet temperature (typically less than 250° F. (121° C.)) and the throughdryer air supply temperature (typically greater than 400° F. (204° C.)). During normal operation, the tissue sheet keeps the papermaking machine contacting surface cool below its melting temperature. When the tissue sheet is removed, the TAD fabric rises in temperature to near the air supply temperature and the material melts off.

(10) Using a material for the web-contacting surface much less resistant to thermal hydrolysis or thermal oxidation than the base belt and using the throughdryer to raise the belt temperature to hydrolyze or oxidize the web-contacting surface. Steam may be optionally be used to facilitate removal of the web-contacting surface by accelerating hydrolysis.

(11) Bending the fabric around a small radius during the removal process can also be used to facilitate removal of the web-contacting surface. For example, a small radius bend may be introduced into the fabric path during the removal process, for example by using one or more movable bars or shoes of suitable cross section. The term "small radius" means a radius that is substantially smaller than the radius of the paper machine fabric section turning rolls.

For any of the above-described modification methods, it can be advantageous to coat the base fabric with a protective material that more readily releases whatever selected material is used for the deposit material. One commercially available release material is sold under the name Marathon™ by Voith Fabrics, Raleigh, N.C.

For all of the foregoing methods of depositing/removing materials, it is particularly advantageous if the material can be added and removed one or two or more times. However, it is within the scope of this invention if the material is added to the fabric and not removed at all. Such a single material add-on step to modify a fabric still provides an advantage over the down time associated with replacing the fabric with a new one. Also, if the material is added while the fabric is on the papermaking machine, the material can be removed while the fabric is on the machine or it can be removed after the fabric has been removed from the machine. In either case, after the material is removed, the fabric can be returned to service with or without new material being added.

If the papermaking fabric to be modified is a non-woven fabric or a woven fabric having a non-woven web-contacting layer, thermal or thermo-mechanical modification of the non-woven fibers to achieve the desired texture in the paper can be readily achieved by passing the fabric through a heated embossing nip having the desired pattern or by passing hot air through the fabric to make it conformable to a mold. In one aspect of such an embodiment, a layer of non-woven material can be laid down on the web-contacting side of the papermaking belt or fabric before reforming the web-contacting surface texture (optionally combined with an aperturing step before and/or after reforming), whereby the fabric basis weight increases each time it is reformed. The base fabric can be woven or non-woven. In this embodiment, material does not have to be removed between texture changes.

By way of example, a fabric with a relatively shallow texture (texture A) could be installed on the paper machine and a product such as facial tissue could be produced. A layer of non-woven fibers could then be added to the base fabric to form a composite fabric, the web-contacting surface of which is formed into a greater texture (texture B). A different grade product could be produced, such as two-ply bath tissue. Another batt of non-woven material could be added to the composite fabric, the web-contacting surface of which is subsequently reformed into a still greater texture (texture C). A different grade product could be produced, such as one-ply bath tissue. Yet another batt of non-woven material could be added to the composite fabric, the web-contacting surface of which is subsequently reformed into an even greater texture (texture D). A different grade product could then be produced, such as a one-ply paper towel. The fabric could then be removed from the machine and a new fabric (texture A) could be installed to repeat the process.

BRIEF DESCRIPTION OF THE DRAWINGS

FIG. 7 is a photograph of the surface of a metal plate having a sinusoidal pattern and which was used to mold (modify) the web-contacting surface of a non-woven throughdrying fabric.

FIG. 8 is a photograph of a non-woven fabric which has been molded to provide a sinusoidal fabric texture.

FIG. 9 is a photograph of an uncreped throughdried handsheet which has been dried on the molded non-woven throughdrying fabric shown in FIG. 8.

FIG. 10 is a photograph of the non-woven throughdrying fabric of FIG. 8 after being remolded into more coarse sinusoidal pattern using a metal plate similar to that shown in FIG. 7.

FIG. 11 is a photograph of a handsheet made on the throughdrying fabric of FIG. 10.

FIG. 12 is a plan photograph of a woven throughdrying fabric useful for making tissue and towel products.

FIG. 13 is a photograph of the fabric of FIG. 12 which has been modified by depositing a thermoplastic polymer onto the web-contacting surface of the woven fabric in the form of a puppy design.

FIG. 14 is a photograph of a throughdried handsheet made on the fabric of FIG. 13.

FIG. 15 is a photograph of the fabric of FIG. 13 after the puppy design has been melted and removed and a new design has been applied.

FIG. 16 is a photograph of a throughdried handsheet made on the fabric of FIG. 15.

DETAILED DESCRIPTION OF THE DRAWINGS

Figure 1:
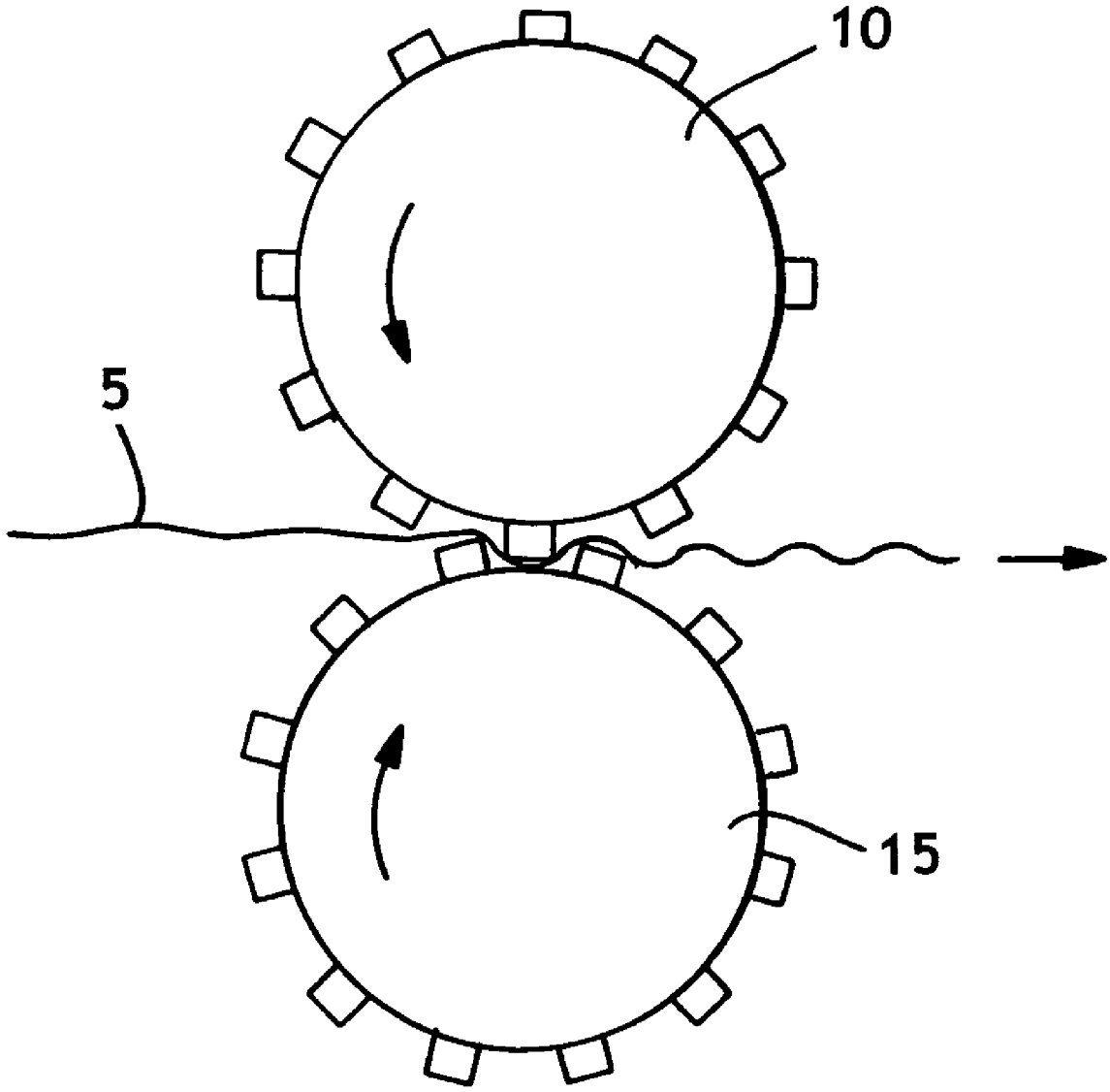
FIG. 1 illustrates an embossing roll nip for modifying the web-contacting surface texture of a papermaking fabric in accordance with this invention.

FIG. 1 depicts a simple reforming process in which the papermaking fabric 5 to be modified is passed between two embossing rolls 10 and 15. The properties of the embossing rolls will be determined by the nature of the particular fabric being modified. A steel/steel embossing roil pair is particularly suitable in which at least one of the steel rolls is heated to soften one or both surfaces of the fabric and modify its texture. As shown, the fabric has one texture when entering the embossing nip and a different texture when leaving the nip.

Figure 2:
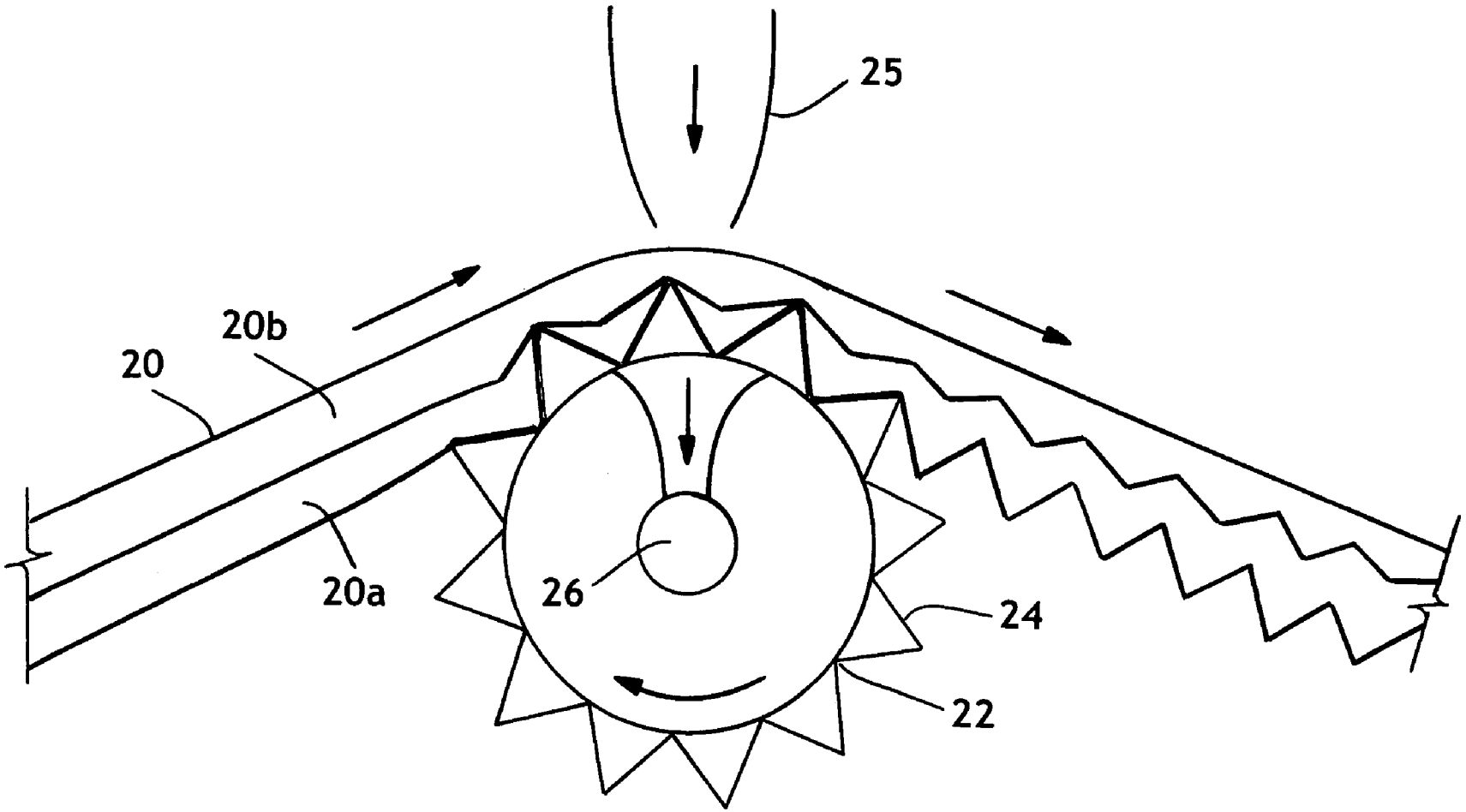
FIG. 2 illustrates another means of modifying the web-contacting surface texture of a papermaking fabric, in this case a papermaking fabric having a deformable non-woven material on the web-contacting surface.

FIG. 2 depicts another reforming process in which a two-ply non-woven tissue making fabric 20 passes over a rotating molding device 22 provided with raised molding elements 24 on the surface. The molding elements 24 as depicted are porous, comprising a material such as sintered metal, sintered ceramic, ceramic foam, or a finely drilled metal or plastic, allowing heated air to pass from an air knife 25 or other source, through the non-woven tissue making fabric 20 and into the rotating molding device 22 and to a vacuum source 26. Heated air from the air knife 25 allows thermoplastic material in at least one of the plies 20*a* and 20*b* of the non-woven material to be thermally molded to conform at least in part to the surface of the rotating molding device. The molding elements 24 can be any shape, such as sine waves, triangles (as shown), square waves, irregular shapes, or other shapes. The rotating molding device 22 can be constructed as a suction roll to allow a narrow zone of vacuum to be applied to a fixed region as the roll rotates. The web-contacting surface of the non-woven tissue making fabric 20 becomes substantially textured after contact with the rotating molding device 22, which can also be heated. The surface of the rotating device can comprise discrete elements and/or can comprise a continuous shell. It is understood that the surface or shell of the rotating molding device 22 comprises a negative image of the desired shape or pattern of the web-contacting surface of the resulting non-woven tissue making fabric. In addition, the negative image on the surface of the rotating molding device 22 of the desired shape or pattern for the web-contacting surface of the non-woven tissue making fabric 20 can be adapted to vary the depth or intensity of the pattern on the web-contacting surface of the non-woven tissue making fabric. The pattern can be continuous curvilinear, discrete elements, or a combination of both types.

Figure 3:
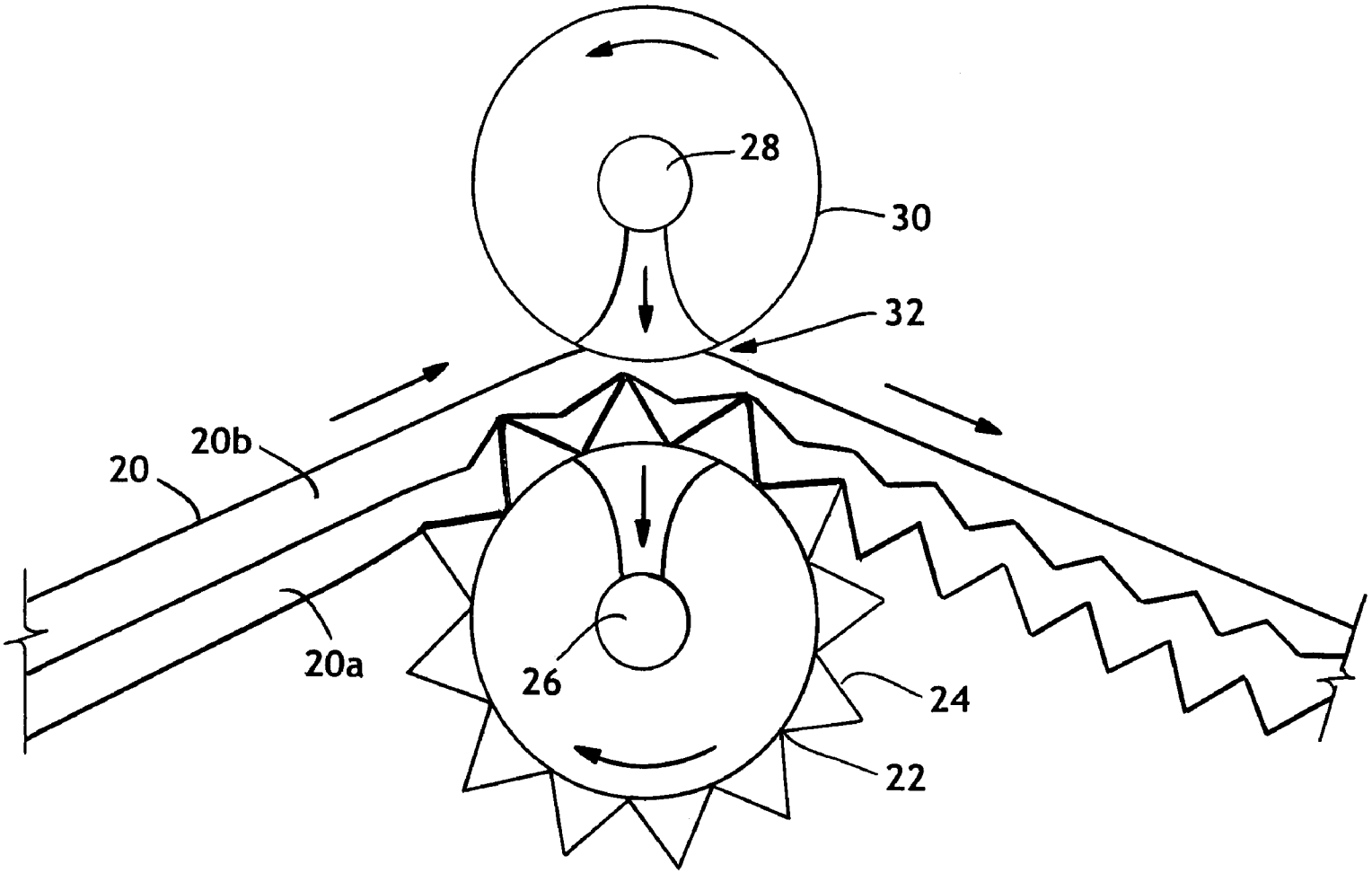
FIG. 3 illustrates another means of modifying the web-contacting surface texture of a papermaking fabric having a non-woven surface component.

FIG. 3 depicts yet another embodiment of a reforming process in which a two-ply non-woven tissue making fabric 20 passes over a rotating molding device 22 provided with raised molding elements 24 on the surface, similar to that shown in FIG. 2, but wherein the air is supplied from a pressurized source 28 connected to a rotating gas-pervious roll 30 through which the pressurized gas passes into a nip 32 between the rotating gas-pervious roll and the counter-rotating molding device. Both the rotating gas-pervious roll 30 and the counter-rotating molding device 22 can be constructed as a suction roll to allow a narrow zone of vacuum to be applied to a fixed region as the gas-pervious roll rotates. In the nip 32, heated air passes through the non-woven tissue making fabric 20 which conforms to the shape of the rotating molding device. A one-sided texture is shown, but both sides of the non-woven tissue making fabric can become molded. Enhanced two-sided molding can be achieved by using a textured rotating gas-pervious roll 30 with a texture that can be essentially a mirror image of the texture of the rotating molding device 22 to permit intermeshing of the textured surfaces of the rotating molding device and the gas-pervious roll in the nip 22. In an alternate embodiment, the gas pervious roll 30 can be fitted with a suitably textured surface to impart a texture to the papermaking machine contacting surface of the fabric 20 which is substantially independent of the texture on the web-contacting surface of the fabric.

Figure 4:
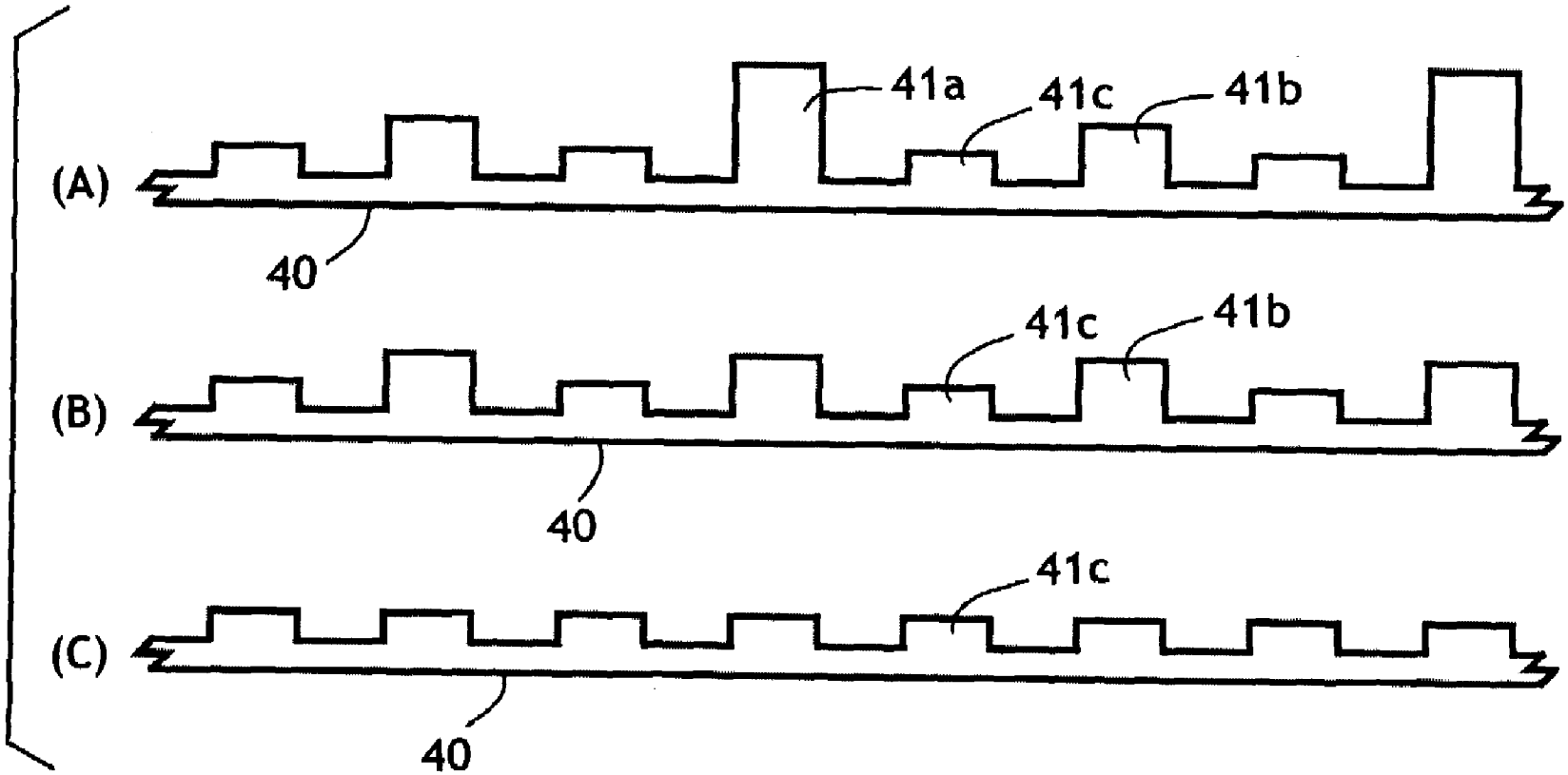
FIGS. 4A, 4B and 4C illustrate the concept of modifying the web-contacting surface texture of a woven fabric or other fabric having removable texture by abrading the web-contacting surface one or more times.

FIGS. 4A, 4B and 4C illustrate the concept of a reforming process which alters the texture of the papermaking fabric by removing texture or portions of texture from the web-contacting surface. As illustrated in FIG. 4A, the texture profile of a fabric 40 is schematically shown by spaced-apart bars 41 of varying heights. In this particular example, bars having three different heights are shown as represented by bars 41*a* (highest), 41*b* (intermediate) and 41*c* (lowest). After being partially abraded, such as by sanding, the highest bars have been shortened and the resulting fabric can have a smoother or lower texture profile as illustrated in FIG. 4B. Upon further abrasion, the fabric 40 becomes even smoother as illustrated in FIG. 4C. In the context of this invention, each of these fabrics could be used to make different paper products which differ at least in their surface characteristics.

Figure 5:
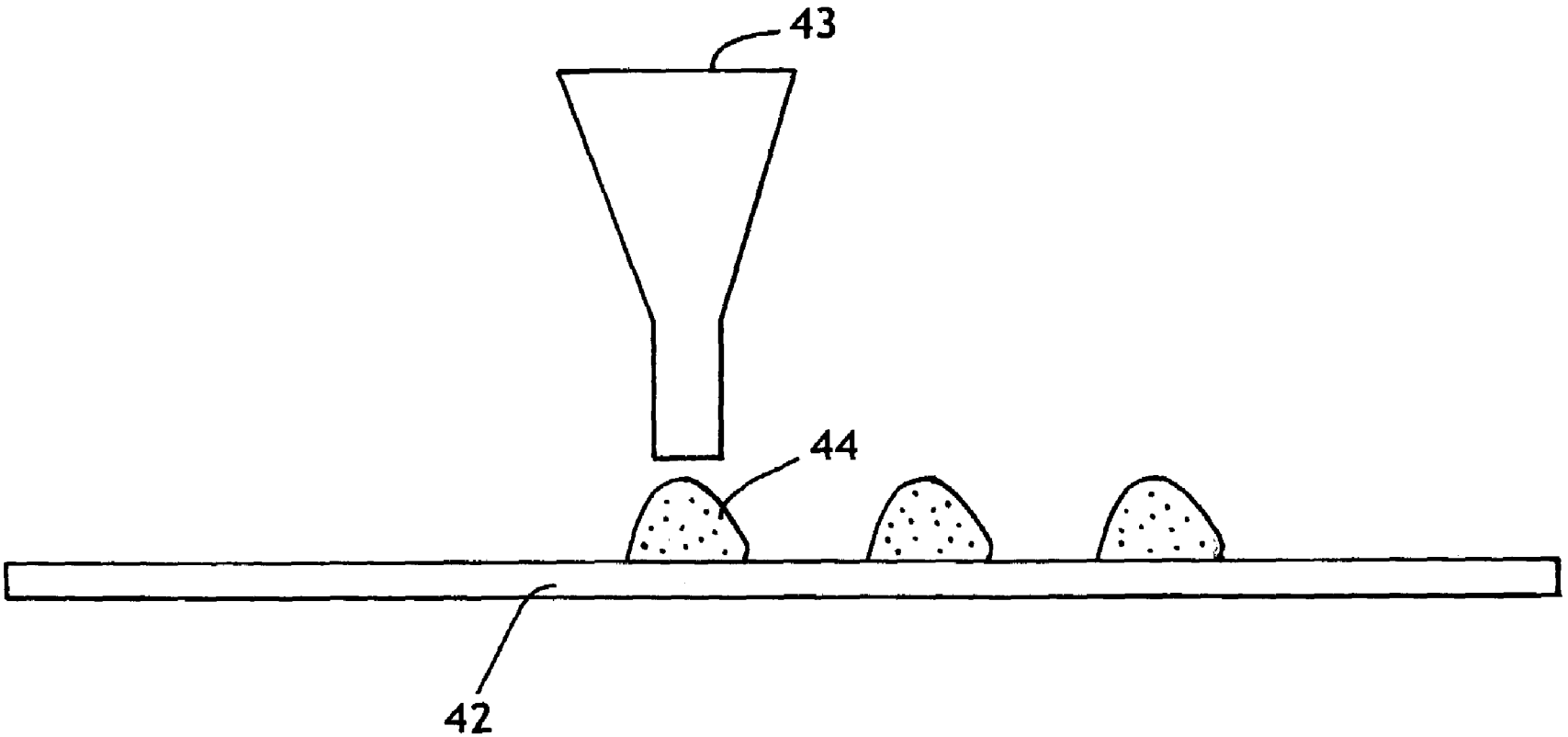
FIG. 5 illustrates the process of adding an extruded material to the web-contacting surface.

FIG. 5 illustrates a simple schematic process for adding material to the web-contacting surface of the fabric. Shown is a material delivery system, such as an extruder 43, depositing the material 44 onto the papermaking fabric 42.

Figure 6:
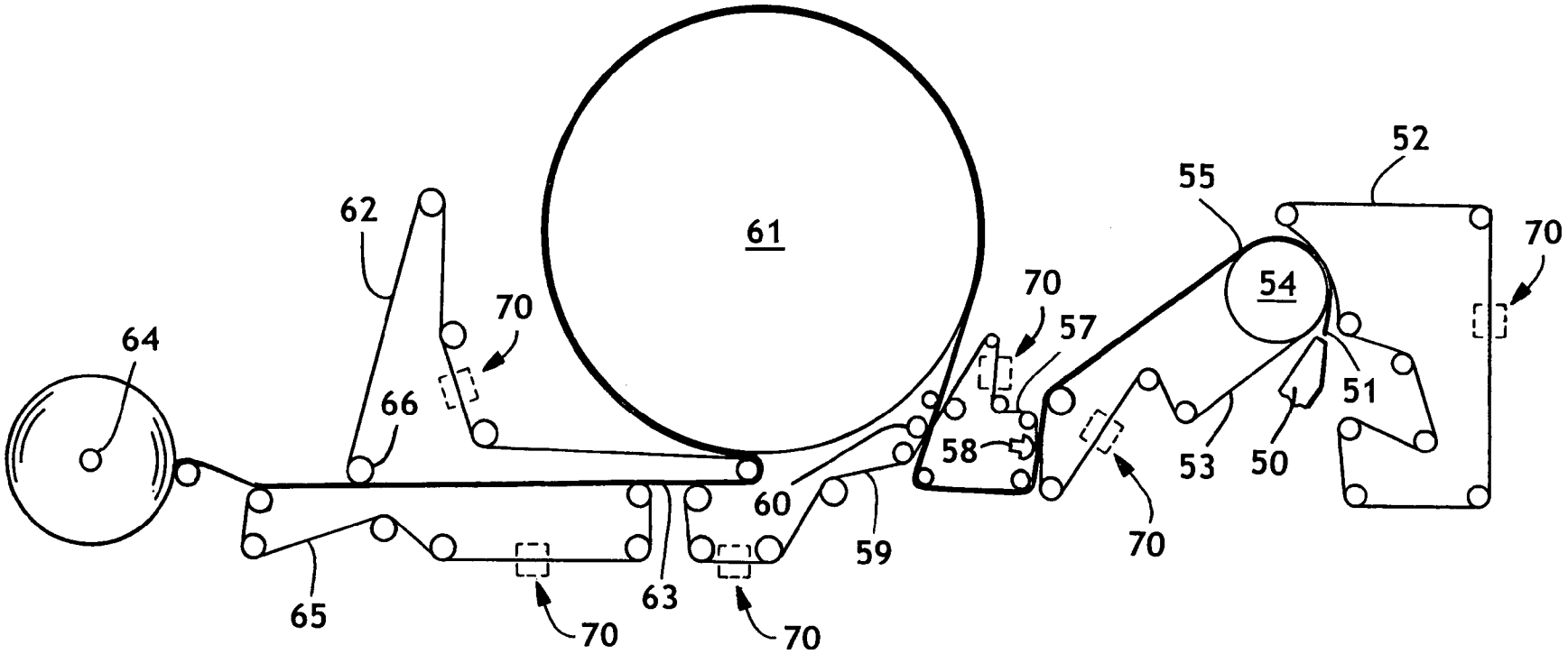
FIG. 6 illustrates a papermaking process in which the web-contacting surface texture of a throughdrying fabric is modified "on the fly".

FIG. 6 illustrates a throughdrying process incorporating a reforming process in which the web-contacting surface texture of the throughdrying fabric is modified on-line without removing the throughdrying fabric from the papermaking machine. Shown is a twin wire former having a papermaking headbox 50 which injects or deposits a stream 51 of an aqueous suspension of papermaking fibers onto a plurality of forming fabrics, such as the outer forming fabric 52 and the inner forming fabric 53, thereby forming a wet tissue web 55. The forming process of the present invention may be any conventional forming process known in the papermaking industry. Such formation processes include, but are not limited to, Fourdrinier formers, roof formers such as suction breast roll formers, and gap formers such as twin wire formers and crescent formers.

The wet tissue web 55 forms on the inner forming fabric 53 as the inner forming fabric revolves about a forming roll 54. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20%, more specifically between about 20% to about 40%, and more specifically about 20% to about 30%. The wet tissue web 55 is then transferred from the inner forming fabric 53 to a transfer fabric 57 traveling preferably at a slower speed than the inner forming fabric in order to impart increased MD stretch into the wet tissue web.

The wet tissue web 55 is then transferred from the transfer fabric 57 to a throughdrying fabric 59 whereby the wet tissue web may be macroscopically rearranged to conform to the web-contacting surface of the throughdrying fabric with the aid of a vacuum transfer roll 60 or a vacuum transfer shoe like the vacuum shoe 58. If desired, the throughdrying fabric 59 can be run at a speed slower than the speed of the transfer fabric 57 to further enhance MD stretch of the resulting absorbent tissue product. The transfer may be carried out with vacuum assistance to ensure conformation of the wet tissue web to the topography of the throughdrying fabric.

While supported by the throughdrying fabric 59, the wet tissue web 55 is dried to a final consistency of about 94 percent or greater by a throughdryer 61 and is thereafter transferred to a carrier fabric 62. Alternatively, the drying process can be any non-compressive drying method that tends to preserve the bulk of the wet tissue web.

The dried tissue web 63 is transported to a reel 64 using a carrier fabric 62 and an optional carrier fabric 65. An optional pressurized turning roll 66 can be used to facilitate transfer of the dried tissue web from the carrier fabric 62 to the carrier fabric 65. If desired, the dried tissue web may additionally be embossed to produce a pattern on the absorbent tissue product using a subsequent embossing stage.

Once the wet tissue web has been non-compressively dried, thereby forming the dried tissue web 63, it is possible to crepe the dried tissue web by transferring it to a Yankee dryer prior to reeling, or using alternative foreshortening methods.

In order to modify the web-contacting surface texture of the throughdrying fabric or any other fabric, such as a forming fabric or transfer fabric, for example, a fabric reforming station 70 (represented by phantom lines) may optionally be located at one or more locations on the paper machine as indicated. It should be noted that reforming a fabric may not only change the texture of the web-contacting surface of the fabric, but reforming may also change other characteristics of the fabric. Particularly in the case of reforming a forming fabric, the drainage characteristics of the forming fabric can be altered. Such reformation can create or change watermarks, for example. Each fabric reforming station can comprise any method as illustrated in FIGS. 1–5. A particularly suitable location for fabric reforming station is along the throughdrying fabric run located below the throughdryer in FIG. 5. During normal operation, the fabric reforming station is disengaged, allowing the fabric to pass through without modification. When a texture modification is desired, the fabric reforming station is engaged and the fabric web-contacting surface is reformed to create a new texture. As discussed above, the paper machine continues to run and product with a new texture imparted by the new texture of the purposefully-modified fabric is produced without the need for a fabric change. The fabric reforming station need only remain engaged for a time sufficient to impart the desired texture to the fabric. Any number of fabric reforming stations can be positioned in series or at different locations on the papermaking machine. Thus, multiple textures can be produced on the same fabric without a fabric change. By using two different texture patterns at the fabric reforming station(s), for example, the texture of the fabric can be changed back and forth numerous times until the fabric wears out.

EXAMPLES

Example 1

In order to further illustrate the method of this invention, a laminated two-layer non-woven throughdrying fabric was produced with a tissue-contacting surface having a relatively fine three-dimensional topography. The fabric was used to produce a molded throughdried handsheet having a correspondingly relatively fine surface. The throughdrying fabric was then remolded to provide the web-contacting surface with a different, coarser three-dimensional topography. This remolded throughdrying fabric was then used to make a second handsheet having a different surface topography (more coarse) relative to the first handsheet.

More specifically, the non-woven base fabric comprised a spunbond web made from bi-component fibers with a concentric sheath-core structure. The sheath material comprised Crystar® 5029 Polyethylene Terephthalate (PET) polyester resin (The DuPont Company, Old Hickory, Tenn., USA). The core material comprised HiPERTUF® 92004 Polyethylene Naphthalate (PEN) polyester resin (M&G Polymers USA LLC, Houston, Tex., USA). The sheath to core ratio was about 1:1 by weight. A bicomponent spunbond web was made in a conventional manner using a forming head having 88 holes per inch (25.4 mm) of face width, the holes having a diameter of 1.35 mm. The polymer was pre-dried overnight in polymer dryers at a temperature of about 320° F. (about 160° C.). The polymer was then extruded at a pack temperature of about 600° F. (about 316° C.) with a pack pressure of about 980 psig (about 6.8 MPa) for the core and about 770 psig (about 5.5 MPa) for the sheath. The polymer flow rate was about 4 grams per hole per minute. The spin line length was about 50 inches (about 127 cm). Quench air was provided at about 4.5 psig (about 31 kPa) and a temperature of about 155° F. (about 68° C.). The fiber draw unit operated at ambient temperature and a pressure of about 4 psig (about 28 kPa). The forming height (height above the forming wire) was about 12.5 inches (about 32 cm). The forming wire speed was about 65 fpm (about 33 cm/s). Bonding was achieved using a hot air knife operating at pressure of about 2.5 psig (about 17 kPa) and a temperature of about 300° F. (about 149° C.) at about 2 inches (about 51 mm) above the forming wire. The resulting non-woven web had an average fiber diameter of about 33 microns, a basis weight of about 100 grams per square meter (gsm), an air permeability of about 630 cubic feet per minute (CFM) (about 17.8 $m^3$/min) and a maximum extensional stiffness of about 96 pounds per lineal inch (pli) (about 17 kg/cm).

Figure 7:
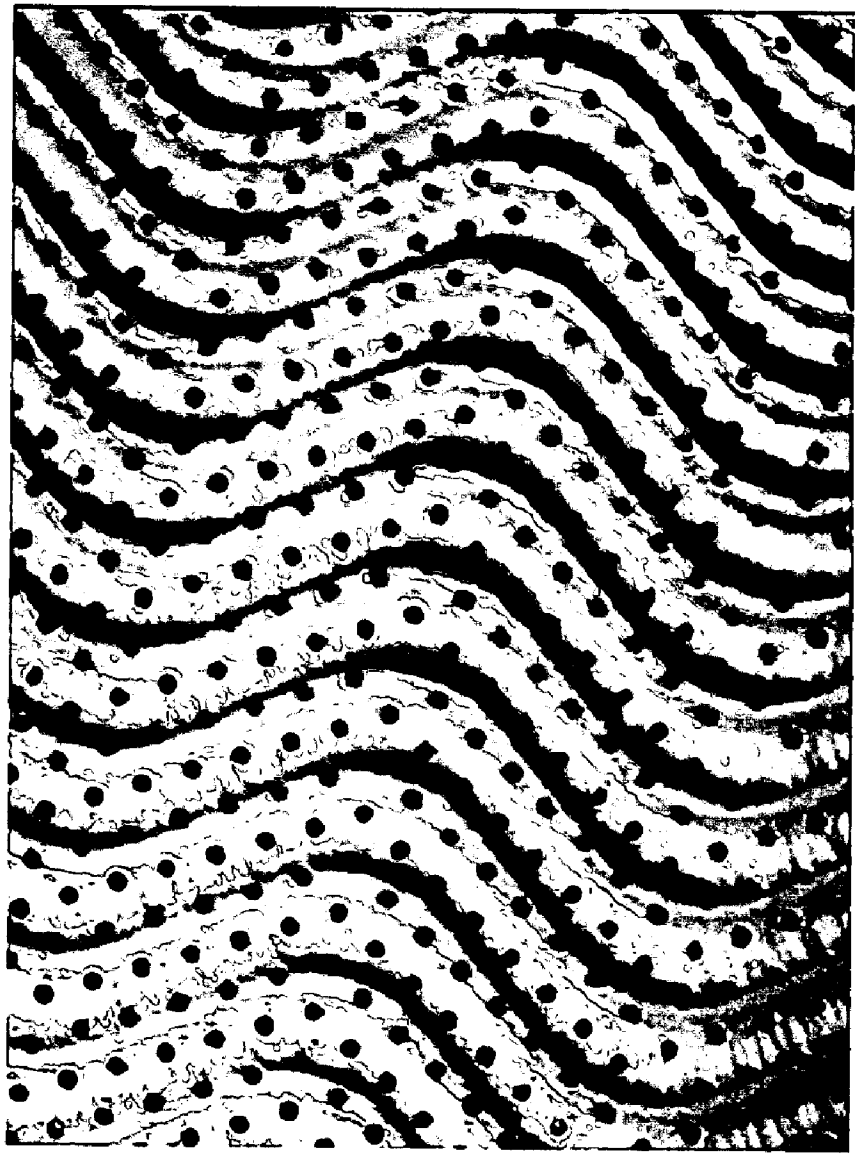
FIGS. 7–11 pertain to the handsheet study of Example 1 described herein. More specifically.

In order to mold the non-woven web into a three-dimensional papermaking fabric, two porous, three-dimensional aluminum plates were prepared from aluminum discs having a thickness of 2 mm and a diameter of 139 mm. A sinusoidal, three-dimensional surface contour was created for each of the two discs by machine-controlled drilling to selectively remove material as specified by a computer aided design (CAD) drawing. For the first plate, hereafter referred to as the "coarse" three-dimensional plate, the channels were specified to be about 0.035 inches (0.889 mm) deep with six channels per inch in the cross-direction. A photograph (having dimensions of about 33 mm by 44 mm) of the resulting molding plate is shown in FIG. 7, illustrating the sinusoidal channels (depressed regions), with spaced-apart holes providing passageways for gas flow. The holes were spaced at 12 per inch (25.4 mm) and had a diameter of 0.030 inch. The machined pattern and the holes were restricted to a circular region about 98 mm in diameter centered in a slightly larger circular plate about 100-mm in diameter. A second metal plate, hereafter referred to as the "fine" three-dimensional plate, was also machined with a similar geometry but with 0.015-inch (0.38 mm) deep channels specified, spaced at 14 per inch (25.4 mm).

Figure 8:
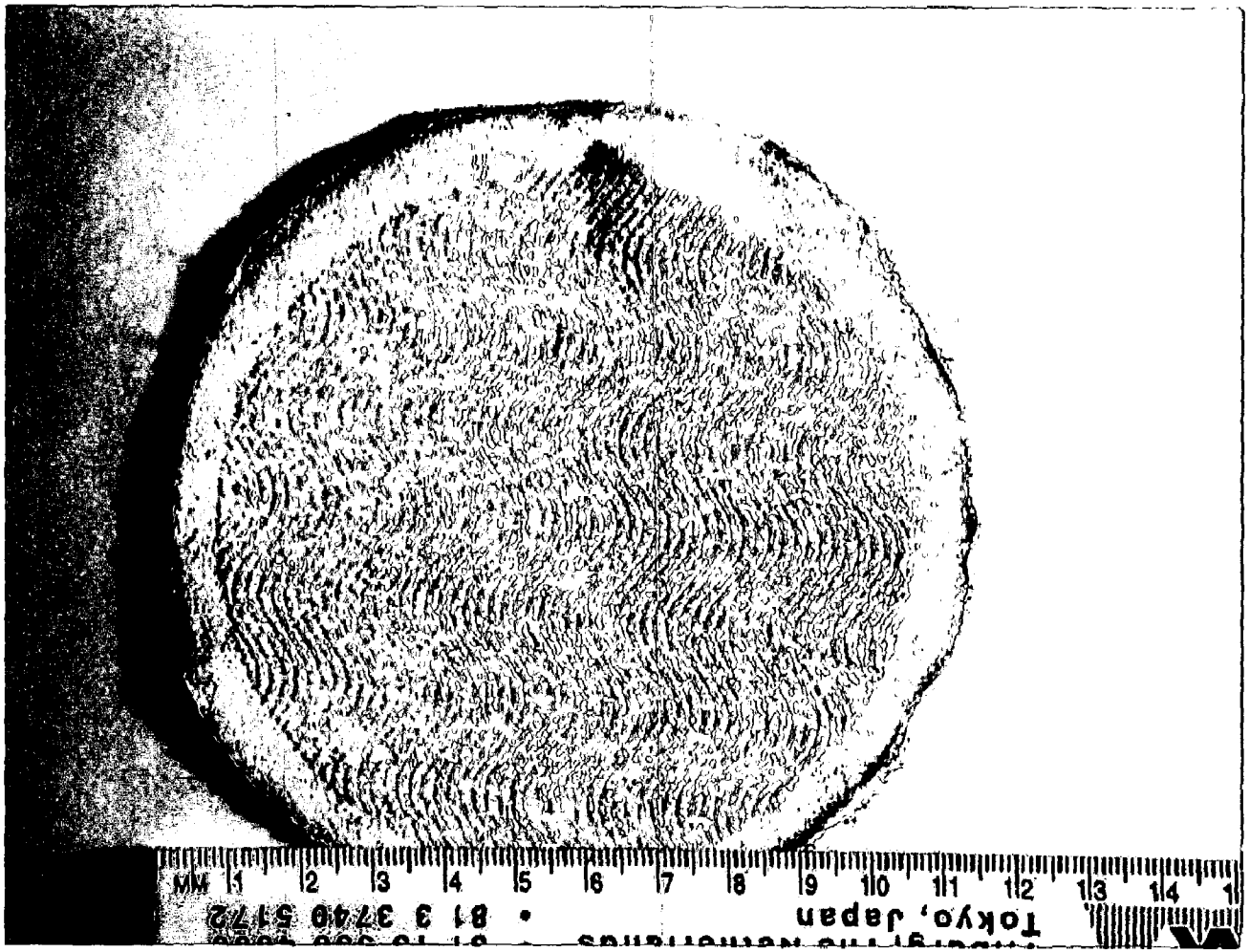

Two plies of the non-woven web described above were superimposed and cut into a disc having a diameter of 140 mm. The resulting two-ply non-woven disc was molded against the fine three-dimensional plate by holding the disc against the fine plate with an opposing flat backing plate, the backing plate having holes drilled with the same size and spacing as in the fine plate. Metal rings with an outer diameter of 139 mm and an inner diameter of about 101 mm and joined with adjustable screws formed a holder for the fine plate, the non-woven disc, and the flat backing plate. Heated air from a hot air gun was applied through a tube about 100 mm in diameter with an air velocity of about 1 meter per second. The tube terminated with the flat backing plate held in place by the assembly of rings. Hot air passed through the backing plate, into the non-woven web, and then out through the holes of the three-dimensional plate. Inlet air temperature was controlled by adjusting the power setting on the heated air gun, with air temperature being measured after the air gun and prior to the backing plate by a thermocouple. The inlet air temperature was initially measured at about 450° F. (about 232° C.). The temperature was gradually increased over a period of about 25 minutes to a peak temperature of about 525° F. (about 274° C.), which temperature was maintained for about 10 minutes. Another thermocouple measured the air temperature after passing through the metal plates and the non-woven laminate. By the time the inlet air temperature had reached about 525° F. (about 274° C.), the outlet air temperature had reached between about 200° F. (about 93° C.) and about 250° F. (about 121° C.). However, after about ten minutes, the outlet air temperature had climbed gradually to about 275° F. (about 135° C.). The hot air gun was then turned off and room-temperature air was passed through the system to cool off the plates and the non-woven laminate. The resulting bonded and molded two-ply laminate was subsequently used to simulate a "fine" patterned throughdrying fabric (TAD fabric) as hereinafter described. The three-dimensional web-contacting surface of the "fine" fabric is shown in FIG. 8.

Tissue handsheet blanks, to be subsequently used in order to simulate papermaking using the above-described non-woven fabrics, were made using a process similar to that illustrated in FIG. 6. In particular, a fiber furnish comprising about 65% bleached eucalyptus fiber and about 35% bleached northern softwood Kraft fiber was fed to a Fourdrinier former using a Voith Fabrics 2164-B33 forming fabric (commercially available from Voith Fabrics in Raleigh, N.C.). The speed of the forming fabric was about 0.33 meters per second. The newly-formed wet tissue web was then dewatered to a consistency of about 30 percent using vacuum suction from below the forming fabric before being transferred to transfer fabric which was traveling at about 0.33 meters per second. The transfer fabric was a Voith Fabrics 952 fabric. A vacuum shoe pulling about 30 centimeters of mercury vacuum was used to transfer the wet tissue web to the transfer fabric.

The wet tissue web was then transferred to a Voith Fabrics t807-1 throughdrying fabric. The throughdrying fabric was traveling at a speed of about 0.25 meters per second (about 30% rush transfer). A vacuum shoe pulling about 30 centimeters of mercury vacuum was used to transfer the wet tissue web to the throughdrying fabric. The wet tissue web was carried over a throughdryer operating at a temperature of about 157° C. and dried to final dryness of at least 97 percent consistency. The resulting uncreped throughdried tissue basesheet had the following properties, without conditioning: Basis Weight, 38 grams per square meter; CD Stretch, 6.1 percent; CD Tensile Strength, 1300 grams per 76.2 millimeters of sample width; MD Stretch, 23 percent; and MD Tensile Strength, 1700 grams per 76.2 millimeters of sample width.

Figure 9:
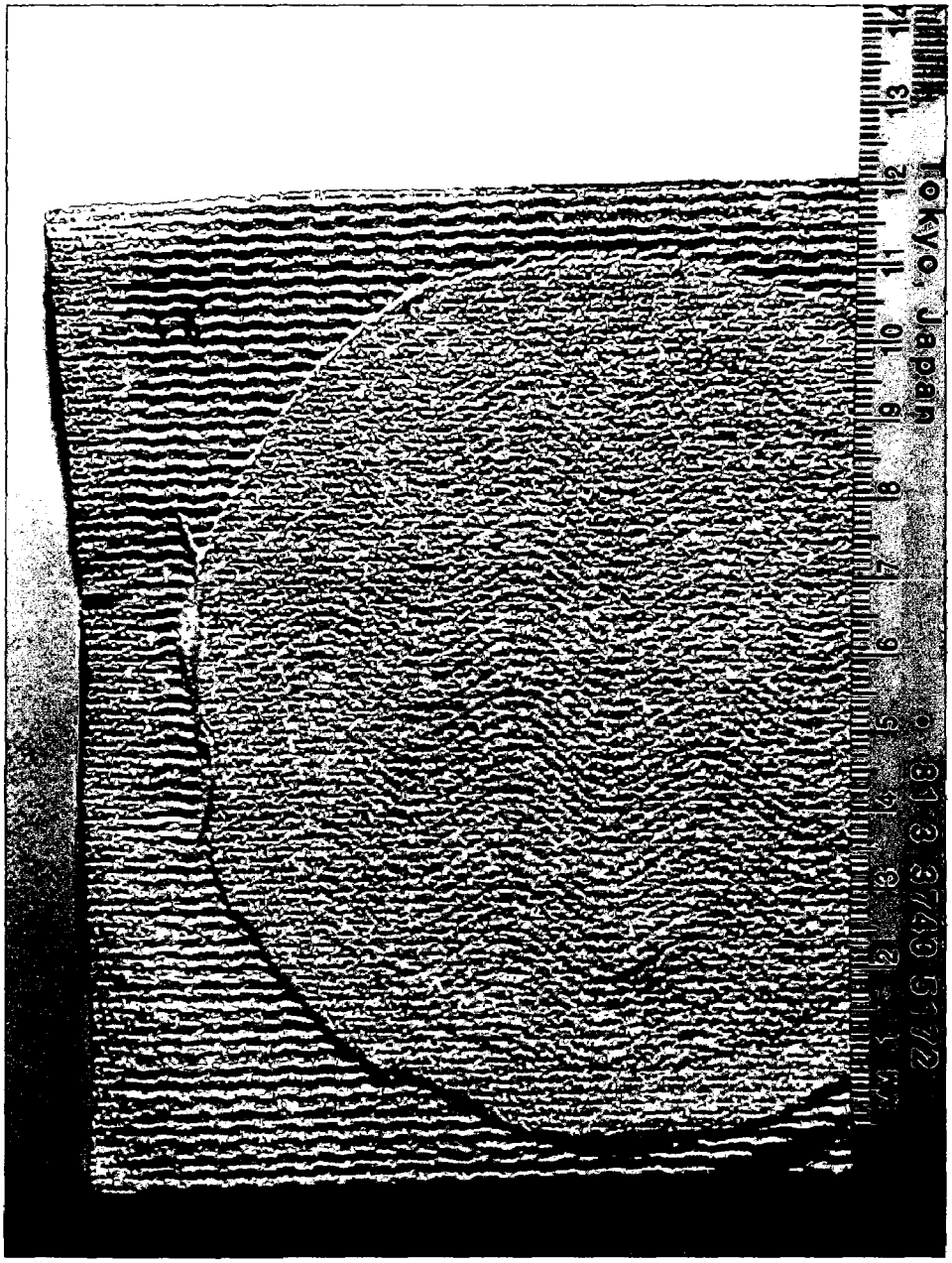

The uncreped throughdried tissue basesheet was cut into handsheet blanks measuring about 5 inches by 4 inches (about 127 mm by 102 mm). The handsheet blank was then molded into the fine patterned TAD fabric of FIG. 8. In particular, the handsheet was made by taking a pre-made blank sheet (see Example 1) and laying it on the web-contacting surface of the fabric. The sheet was then wetted to bring the solids content of the wet sheet down to 25%. The wet sheet, still on top of the patterned fabric, was then molded by traversing a vacuum slot (about ½" (about 12.7 mm) slot width) at a vacuum of about 41" (about 104 cm) water column. The fabric and sheet together were moved back and forth over the vacuum slot until the solids content was about 95%. The dry sheet was then removed from the patterned fabric. The resulting tissue product, as shown in FIG. 9, exhibited the fine pattern of the TAD fabric.

In accordance with the method of this invention, the fine pattern TAD fabric of FIG. 8 was heated as described above while being pressed lightly between the flat backing plate and the "coarse" three-dimensional plate. The fabric and the coarse plate were arranged so that the fine and coarse patterns were substantially in alignment. The resulting remolded TAD fabric exhibited the "coarse" pattern of the coarse three-dimensional plate. The web-contacting surface of the remolded fabric is shown in FIG. 10.

Figure 10:
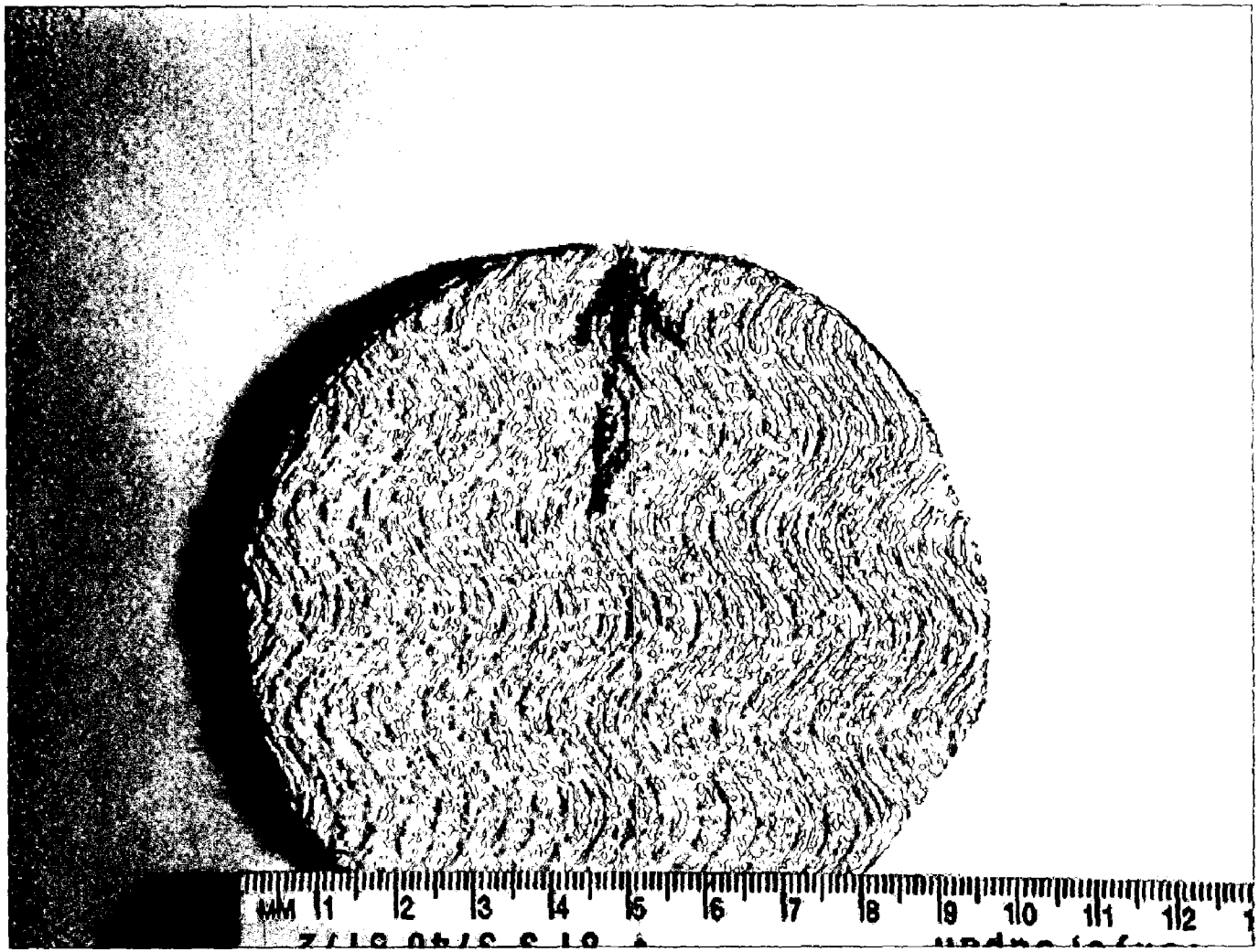
Figure 11:
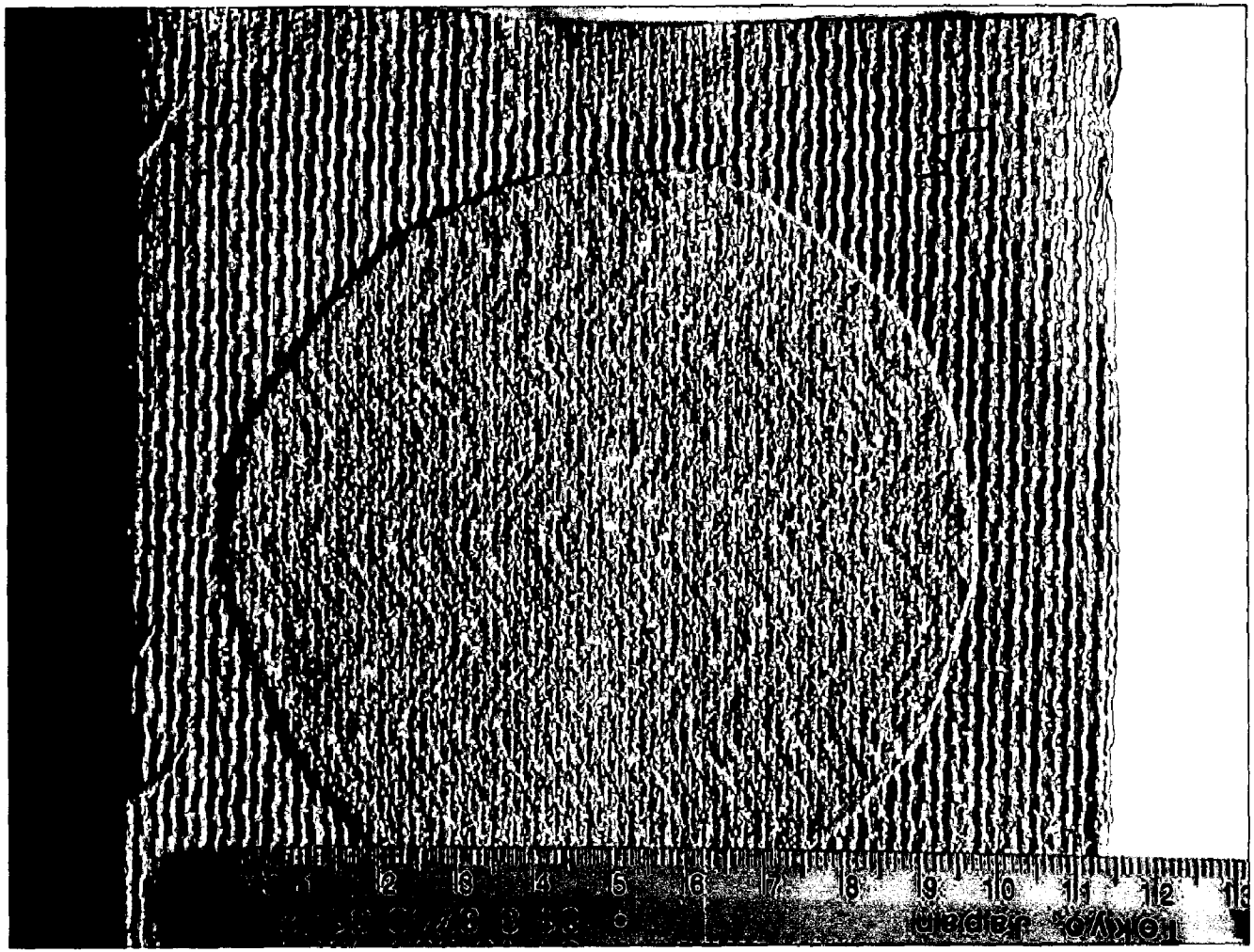

Using the remolded course TAD fabric, an uncreped throughdried tissue handsheet blank was molded into the fabric of FIG. 10 in the manner described above, resulting in the coarse patterned handsheet shown in FIG. 11.

Example 2

Figure 12:
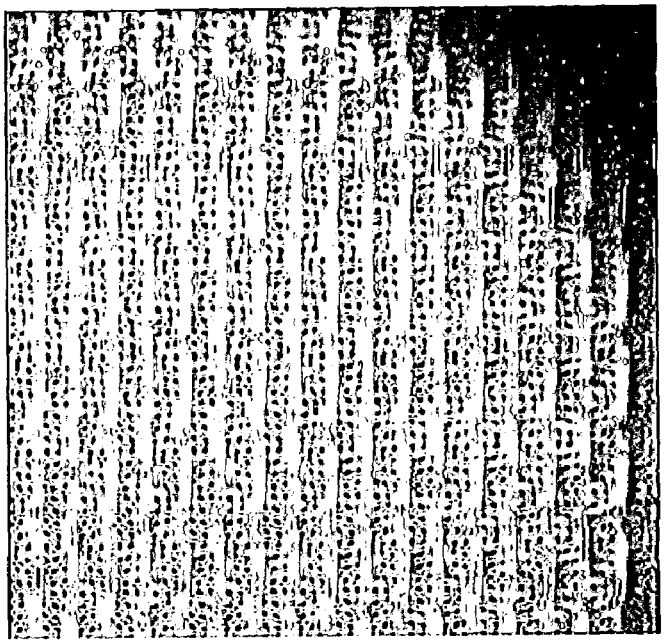
FIGS. 12–16 pertain to the handsheet study described in Example 2. More specifically.
Figure 13:
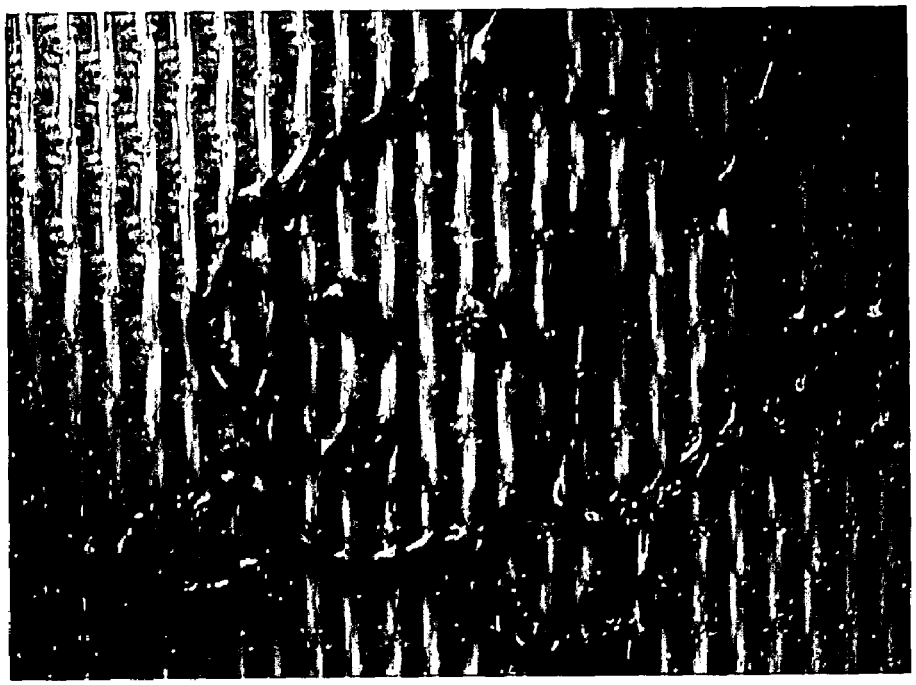

To illustrate a different method of reforming papermaking fabrics in accordance with this invention, a strand of thermoplastic long-chain hydrocarbon wax (Uchida of America, Co, Torrance, Calif. 90503) was applied via extrusion to the top surface of a woven fabric (style t1207-6, Voith Fabrics, Florence, Miss.). A photograph of the woven fabric is shown in FIG. 12. The wax strand was applied to form a decorative raised pattern above the plane of the fabric base texture as shown in FIG. 13.

Figure 14:
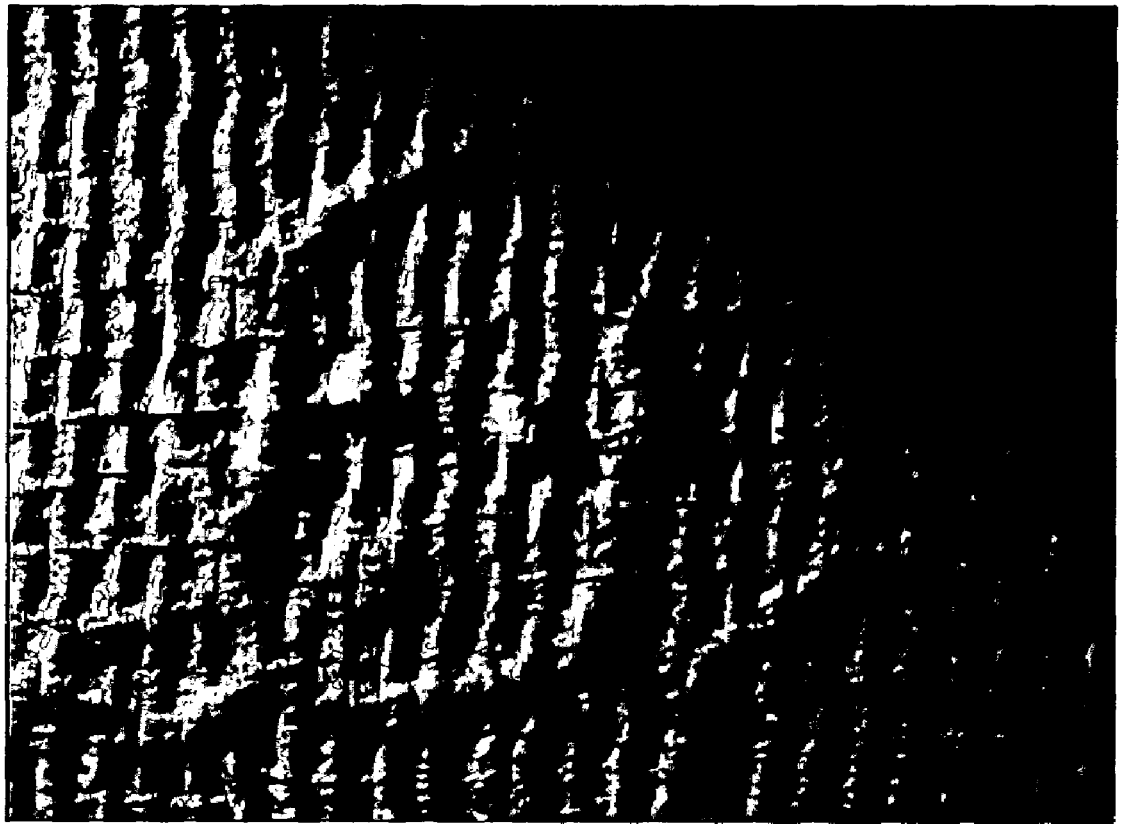

Following the handsheet procedure described in connection with Example 1, a handsheet was made from this fabric. In particular, the handsheet was made by taking a pre-made blank sheet (see Example 1) and laying it on top of the patterned side of the fabric. The sheet was then wetted to bring the solids content of the wet sheet down to 25%. The wet sheet, still on top of the patterned fabric, was then molded by traversing a vacuum slot (about ½" (about 12.7 mm) slot width) at a vacuum of about 41" (about 104 cm) water column. The fabric and sheet together were moved back and forth over the vacuum slot until the solids content was about 95%. The dry sheet was then removed from the patterned fabric. The resultant sheet is shown in FIG. 14.

Figure 15:
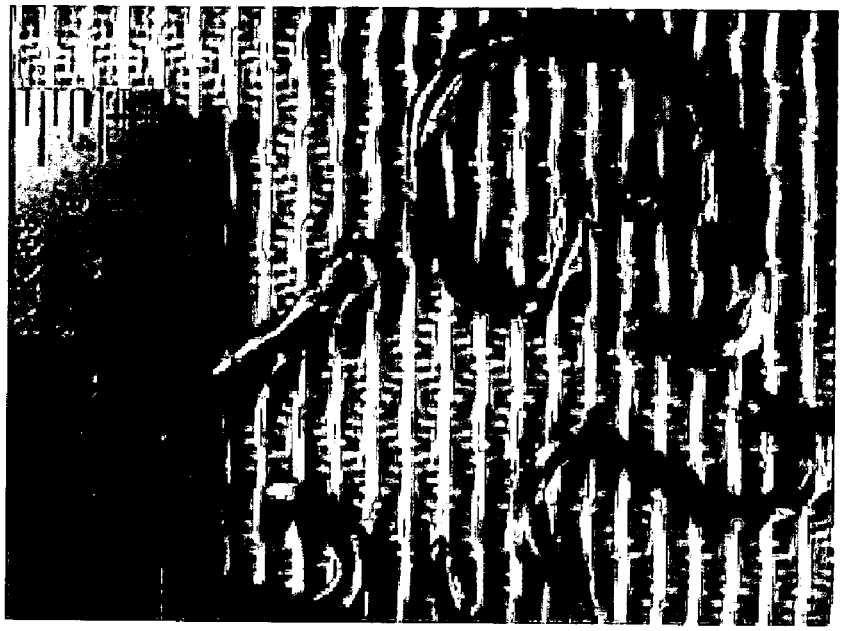
Figure 16:
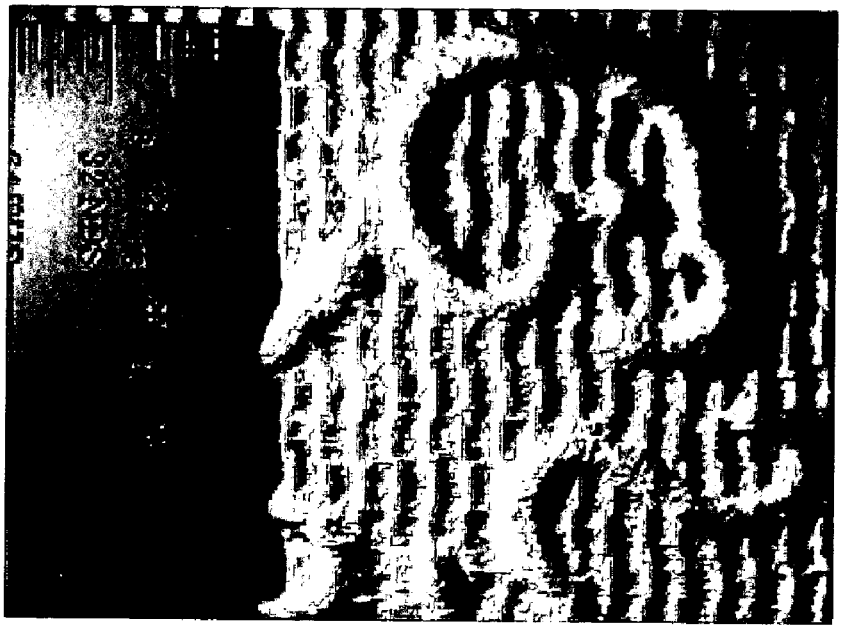

The fabric with the applied pattern was then heated using a household laundry iron to melt off the wax strands from the base fabric. After flushing the web-contacting surface briefly with water to remove any residue, a second (different) wax strand pattern was applied to the web-contacting surface of the fabric to reform the web-contacting surface design as shown in FIG. 15. A handsheet was thereafter made from the reformed fabric to produce a new product with a different pattern as shown in FIG. 16.

It will be appreciated that the foregoing description and examples, given for purposes of illustration, are not to be construed as limiting the scope of the invention, which is defined by the following claims and all equivalents thereto.

We claim:

1. A method of making paper in which a web of papermaking fibers is supported by the web-contacting surface of a fabric, wherein the web-contacting surface of the fabric is purposefully modified without removing the fabric from the papermaking machine.

2. The method of claim 1 wherein the web-contacting surface of the fabric is modified without halting the rotation of the fabric.

3. The method of claim 1 wherein the fabric is a throughdrying fabric.

4. The method of claim 1 wherein the fabric is a forming fabric.

5. The method of claim 1 wherein the fabric is transfer fabric.

6. The method of claim 1 wherein the web-contacting surface of the fabric is modified by depositing a material onto the web-contacting surface.

7. The method of claim 6 wherein the material is removable.

8. The method of claim 7 wherein the material is removable by washing.

9. The method of claim 8 wherein the material is removable by changing the pH of the washing solution.

10. The method of claim 7 wherein the material is removable by a chemical reaction.

11. The method of claim 10 wherein the chemical reaction comprises thermal oxidation.

12. The method of claim 10 wherein the chemical reaction comprises thermal hydrolysis.

13. The method of claim 7 wherein the material is removable by dissolution in a non-aqueous solvent.

14. The method of claim 7 wherein the material is removable by exposure to ultra-violet light.

15. The method of claim 7 wherein the material is removable by exposure to ultrasonic vibrations.

16. The method of claim 7 wherein the material is removable by abrasion.

17. The method of claim 7 wherein the material is removable by thermal shock.

18. The method of claim 7 wherein the material is removable by bending the fabric around a small radius.

19. The method of claim 6 wherein the material is deposited by printing or extruding.

20. A method of making paper in which a web of papermaking fibers is supported by the web-contacting surface of a fabric, wherein the structure of the fabric is purposefully modified, either while the fabric is on-line or off-line, such that the structure of the resulting paper is changed, wherein the web-contacting surface of the fabric is thermally modified by heating the fabric surface, reconfiguring the heated fabric surface by through-air-molding to change the web-contacting surface texture and cooling the fabric surface to set the reconfigured texture.

21. A method of making a throughdried tissue on a papermaking machine in which a throughdrying fabric contacts and supports a tissue web while the web is being dried, wherein the texture of the web-contacting surface of the throughdrying fabric, while not in contact with the web, is purposefully modified without removing the throughdrying fabric from the papermaking machine.

22. The method of claim 21 wherein the texture of the web-contacting surface of the throughdrying fabric is purposefully modified without halting rotation of the throughdrying fabric.

23. A method of making tissue comprising:

(a) making a first throughdried tissue on a papermaking machine in which a throughdrying fabric contacts and supports a tissue web while the web is being dried, wherein the texture of the web-contacting surface of the throughdrying fabric imparts a first texture to the first tissue;

(b) reforming the web-contacting surface of the throughdrying fabric from a first texture to a second texture; and (c) making a second throughdried tissue wherein the second texture of the web-contacting surface of the throughdrying fabric imparts a second texture to the second tissue.

24. The method of claim 23 wherein the throughdrying fabric is reformed without removing the throughdrying fabric from the papermaking machine.

25. The method of claim 23 wherein the throughdrying fabric is reformed while the papermaking machine is running.

26. The method of claim 23 wherein the throughdrying fabric is reformed without halting the rotation of the throughdrying fabric.

27. The method of claim 23 wherein the texture of the papermaking machine contacting side of the throughdrying fabric is modified during reforming.

28. A method of making paper on a papermaking machine in which a web of papermaking fibers is supported by the web-contacting surface of a forming fabric which imparts a watermark to the web, wherein the web-contacting surface of the forming fabric is purposefully modified without removing the forming fabric from the papermaking machine, such that the watermark imparted by the forming fabric is changed.

29. A method of making paper on a papermaking machine in which a web of papermaking fibers is supported by the web-contacting surface of a forming fabric, wherein the forming fabric is supported by an open form roll sleeve which imparts a watermark to the web, wherein the open form roll sleeve is purposefully modified, either while the form roll sleeve is on-line or off-line, such that the watermark imparted by the open form roll sleeve is changed.

30. A used papermaking fabric having a web-contacting surface wherein the structure of the fabric has been purposefully modified for re-use by heating, reforming by through-air-molding and cooling the fabric.

31. The papermaking fabric of claim 30 wherein the fabric is a woven fabric.

32. The papermaking fabric of claim 30 wherein the fabric is a non-woven fabric.

33. The papermaking fabric of claim 30 wherein the fabric comprises a combination of woven and non-woven components.

* * * * *